US008801455B2

(12) United States Patent
Carreras Garcia et al.

(10) Patent No.: US 8,801,455 B2
(45) Date of Patent: Aug. 12, 2014

(54) ELECTRICAL CONNECTOR

(75) Inventors: Antonio Carreras Garcia, Barcelona (ES); Jose Jaime Sanabra Jansa, Barcelona (ES)

(73) Assignee: Tyco Electronics Amp Espana SA, Barcelona (ES)

( * ) Notice: Subject to any disclaimer, the term of this patent is extended or adjusted under 35 U.S.C. 154(b) by 158 days.

(21) Appl. No.: 13/319,969

(22) PCT Filed: Apr. 27, 2010

(86) PCT No.: PCT/EP2010/055655

§ 371 (c)(1), (2), (4) Date: Nov. 10, 2011

(87) PCT Pub. No.: WO2010/130574

PCT Pub. Date: Nov. 18, 2010

(65) Prior Publication Data

US 2012/0058667 A1 Mar. 8, 2012

(30) Foreign Application Priority Data

May 11, 2009 (EP) ..... 09382067

(51) Int. Cl.
*H01R 4/40* (2006.01)

(52) U.S. Cl.
USPC ..... 439/417

(58) Field of Classification Search
USPC ..... 439/417
See application file for complete search history.

(56) References Cited

U.S. PATENT DOCUMENTS

| | | | | |
|---|---|---|---|---|
| 7,905,744 | B1 * | 3/2011 | Amidon | 439/417 |
| 2005/0266720 | A1 * | 12/2005 | Lin | 439/418 |
| 2008/0020652 | A1 * | 1/2008 | Caveney et al. | 439/676 |
| 2008/0132123 | A1 * | 6/2008 | Milette et al. | 439/676 |

FOREIGN PATENT DOCUMENTS

| | | | |
|---|---|---|---|
| EP | 1422793 | A1 | 5/2004 |
| EP | 1484824 | A2 | 12/2004 |
| WO | WO 2005/104300 | A1 | 11/2005 |
| WO | WO 2008/059203 | A2 | 5/2008 |

OTHER PUBLICATIONS

International Search Report and Written Opinion issued by the European Patent Office, Rijswijk, Netherlands, dated Jul. 5, 2010, for International Application No. PCT/EP2010/055655; 8 pages.
International Preliminary Report on Patentability issued by the International Bureau of WIPO, Geneva, Switzerland, dated Nov. 15, 2011 for International Application No. PCT/EP2010/055655; 5 pages.

* cited by examiner

*Primary Examiner* — Gary Paumen
(74) *Attorney, Agent, or Firm* — Merchant & Gould P.C.

(57) ABSTRACT

A cap for an electrical connector comprises a housing and a first cutting member with a first cutting blade. The housing includes an aperture for receiving a cable therethrough. The housing comprises at least a first wire guiding for guiding a first wire of the cable between the aperture and a first recess in a first outside wall of the housing. The first cutting member is arranged in a first slot of the housing and crosses the first wire guiding between the aperture and the first recess. The first cutting member is provided for cutting the first wire.

15 Claims, 17 Drawing Sheets

ELECTRICAL CONNECTOR

The invention relates to a cap for an electrical connector according to claim 1, to a termination assembly for an electrical connector according to claim 8 and to an electrical connector according to claim 14.

When there is a requirement in the field to terminate a cable containing a plurality of wires with a connector containing a plurality of terminals, the operation can be difficult to perform, particularly if the cable is of the type typically used for telecommunication applications which normally contain a significant number of small diameter wires. The documents EP 1 422 793 B1, WO 2005/104300 A1 and WO 2008/059203 A2 disclose examples of prior art devices for terminating cables.

It is an object of the invention to provide an improved cap for an electrical connector. This objective is achieved by a cap according to claim 1. It is a further object of the invention to provide an improved termination assembly for an electrical connector. This objective is achieved by termination assembly according to claim 8. It is a further object of the invention to provide an improved electrical connector. This objective is achieved by an electrical connector according to claim 14. Preferred embodiments are disclosed in the depended claims.

A cap for an electrical connector according to the invention comprises a housing and a first cutting member with a first cutting blade. The housing includes an aperture for receiving a cable therethrough. The housing comprises at least a first wire guiding for guiding a first wire of the cable between the aperture and a first recess in a first outside wall of the housing. The first cutting member is arranged in a first slot of the housing and crosses the first wire guiding between the aperture and the first recess. The first cutting member is provided for cutting the first wire. An advantage of this cap is that the wire of the cable is automatically cut when the cap is mated with a matching termination assembly. Advantageously this simplifies the termination of the cable.

In a preferred embodiment of the cap the first cutting member comprises at least one opening, wherein the opening is arranged between the first recess in the housing and the first wire guiding. An end of the first wire is arranged in the opening after the first wire has been cut by the first cutting member. Favourably, the openings in the first cutting member ensure that individual wires of the cable are not short-circuited via the cutting member.

In an alternative embodiment of the cap the first cutting member comprises a height that is lower than the depth of the first wire guiding. The first cutting member is arranged in the first slot such that there is a clearance between the first cutting member and a floor of the first wire guiding. Advantageously a cut wire may than be arranged in the clearance between the cutting member and the floor of the wire guiding, avoiding a short-circuit between individual wires of the cable via the cutting member.

Preferentially the housing of the cap includes an electromagnetic shielding component for electrically contacting a shield of the cable. Such shielding component provides a beneficial electromagnetic shielding of the cap against the emission and immission of electromagnetic radiation.

It is convenient to form the housing of the cap of a conductive material such that the shielding component is constituted by the housing itself. This provides an effective and cost-saving shielding of the cap.

According to a further development the cap comprises a second wire guiding for guiding a second wire of the cable between the aperture and the second recess in a second outside wall of the housing and a second cutting member including a second cutting blade. The second cutting member is arranged in a second slot of the housing and crosses the second wire guiding between the aperture and the second recess. This further development advantageously provides enough space for contacting a large amount of wires.

It is preferred that the cap comprises a locking member for locking the cable in the aperture. Advantageously the locking member protects the cable against accidentally being pulled out of the cap.

A termination assembly for an electrical connector according to the invention comprises a housing and an insulation displacement contact for contacting a wire. The insulation displacement contact extends upright from an outer surface of the housing. The termination assembly is designed for being mated with a cap of the afore-described kind.

Preferentially the termination assembly comprises at least a first block that is arranged next to the insulation displacement contact on the outer surface of the housing. The first block is provided for pressing a wire against a cutting blade of the cap when the termination assembly is mated with the cap. Advantageously the block ensures a cutting of the wire when the cap and the termination assembly are mated.

According to another preferred embodiment the termination assembly comprises also a second block that is arranged next to the insulation displacement contact on the outer surface of the housing such that the insulation displacement contact is arranged between the first block and the second block. Advantageously this ensures the cutting of the wire in an even more reliable way when the cap and the termination assembly are mated.

According to a further development the termination assembly comprises a cutting member with a cutting blade, wherein the cutting member is arranged upright on the outer surface of the housing. In this embodiment the cutting member of the cap and the cutting member of the termination assembly together cut the wire like a pair of scissors.

In a preferred embodiment the termination assembly comprises a socket with a conductive pin that is electrically connected to the insulation displacement contact. Advantageously the pin of the socket is then electrically connected to the wire of the cable via the insulation displacement contact when the cap and the termination assembly are mated.

Preferentially the socket is of the registered jack type. This allows to apply the termination assembly for telecommunication and other applications.

An electrical connector according to the invention comprises a cap of the afore-described type and a termination assembly of the afore-described type.

In a preferred embodiment of the electrical connector the first wire guiding of the cap comprises a third recess for receiving the insulation displacement contact of the termination assembly. The third recess comprises a rectangular opening. No border of the rectangular opening is parallel to the first cutting member. This tilted arrangement of the insulation displacement contact and the third recess for receiving the insulation displacement contact advantageously allows for a compact design of the electrical connector.

The invention will now be explained in greater detail with reference to the figures in which FIG. 1 shows a perspective view of a cap according to a first embodiment;

Figure 1:
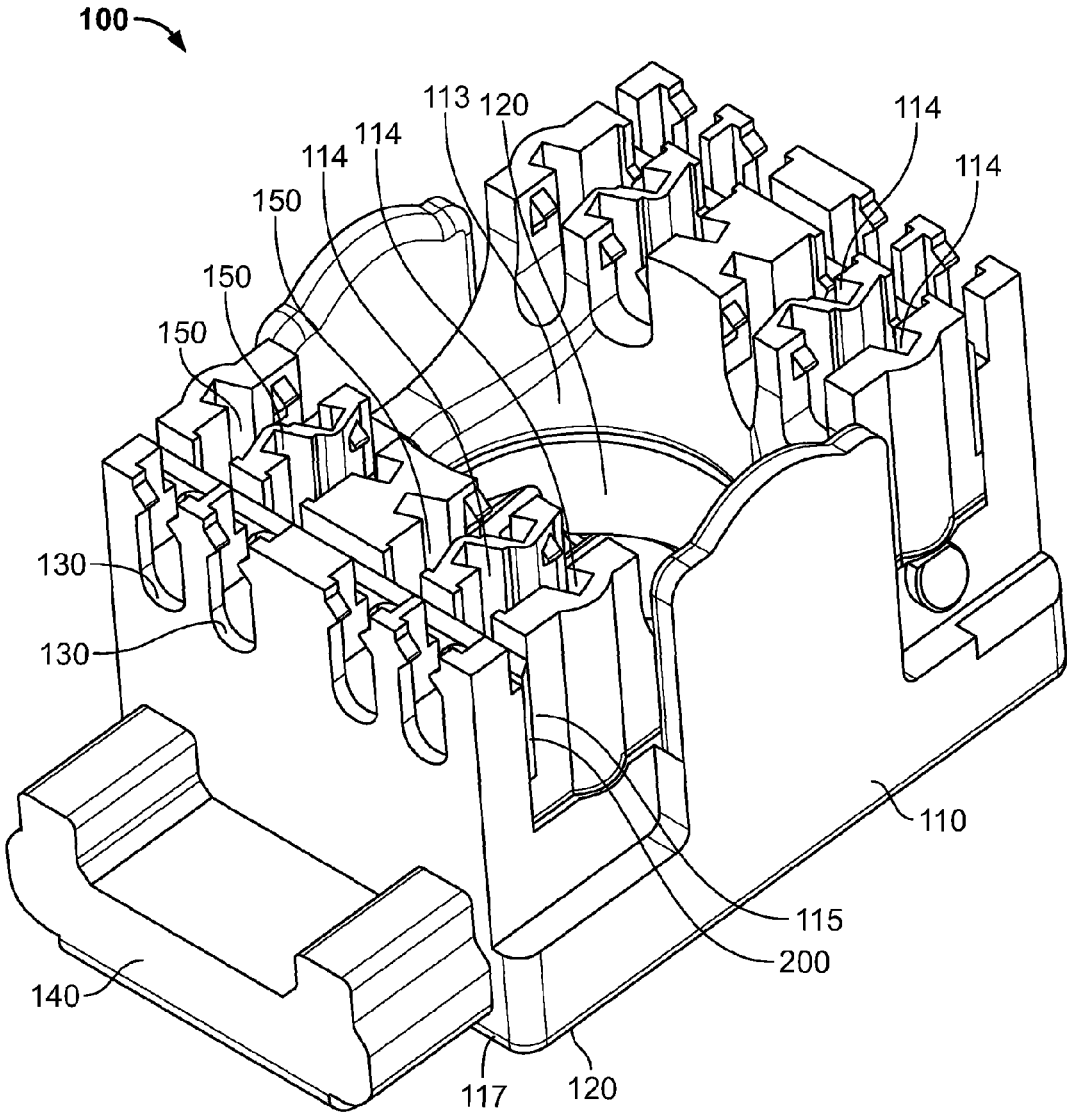
Figure 2:
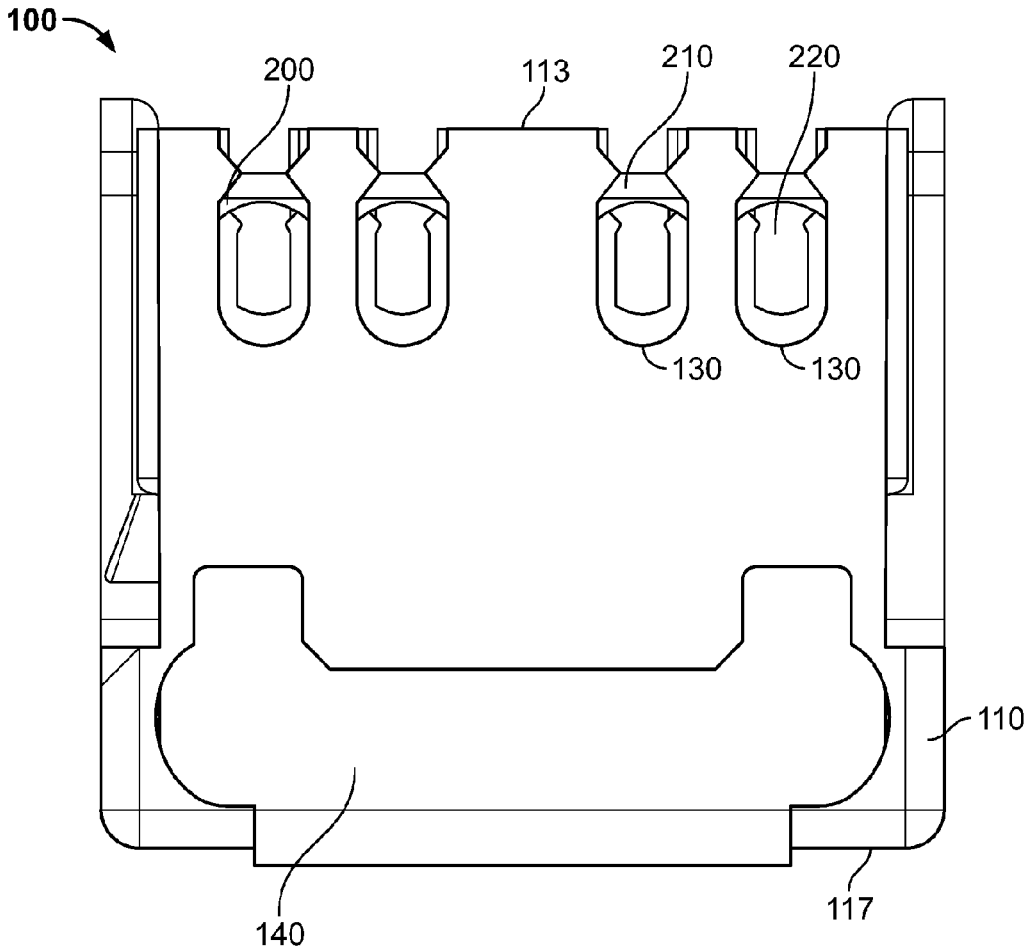
FIG. 2 shows a front view of the cap.

FIG. 1 shows a perspective view of a cap 100 for an electrical connector according to a first embodiment. FIG. 2 shows a front view of the cap 100. The cap 100 comprises a housing 110 with an inner side 113 and an outer side 117. The cap 100 can be mated with a matching termination assembly to form an electrical connector. The inner side 113 of the housing 110 then forms a mating face. An aperture 120 extends from the outer side 117 to the inner side 113 of the housing 110. The aperture 120 is provided for receiving a cable.

A front side of the housing 110 that extends between the inner side 113 and the outer side 117 comprises four recesses 130 that extend from an edge between the front side and the inner side 113 of the housing 110 into the front side of the housing 110. The inner side 113 comprises four wire guidings 150. Each wire guiding 150 extends from a central area of the inner side 113 near the aperture 120 to one recess 113 respectively. A slot 115 extends from the inner side 113 into the housing 110 in parallel to the front side of the housing 110. Arranged in the slot 115 is a cutting member 200. The cutting member 200 therefore crosses the wire guidings 150 at an angle of approximately 90 degrees.

The front side of the housing 110 further comprises a locking member 140 that can be pushed into the housing 110 and pulled out of the housing 110 like a drawer. If the locking member 140 is pushed into the housing 110 the locking member 140 locks a cable inside the aperture 120, preventing an accidental removal of the cable from the aperture 120.

Figure 3:
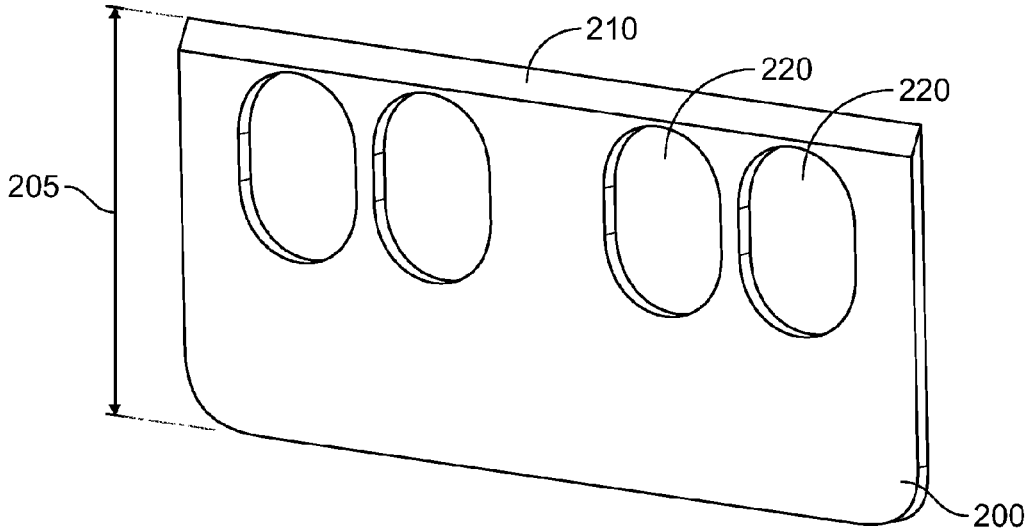
FIG. 3 shows a cutting member according to the first embodiment.

FIG. 3 shows a perspective view of the cutting member 200. The cutting member 200 may for example be formed of a metal. The cutting member 200 comprises an approximately rectangular shape. Along one edge of the rectangular cutting member 200 is arranged a cutting blade 210. The cutting blade 210 is hard enough and sharp-edged enough for cutting a metallic wire. In a direction perpendicular to the cutting blade 210 the cutting member 200 comprises a height 205. Arranged in parallel to the cutting blade 210 the cutting member 200 comprises four openings 220. The openings 220 are positioned such that when the cutting member 200 is inserted into the slot 115 of the cap 100 the four openings 220 are lined with the four recesses 130 and the four wire guidings 150. This can be seen in FIG. 2. Each opening 220 therefore provides an opening between a recess 130 and a respective wire guiding 150.

Figure 4:
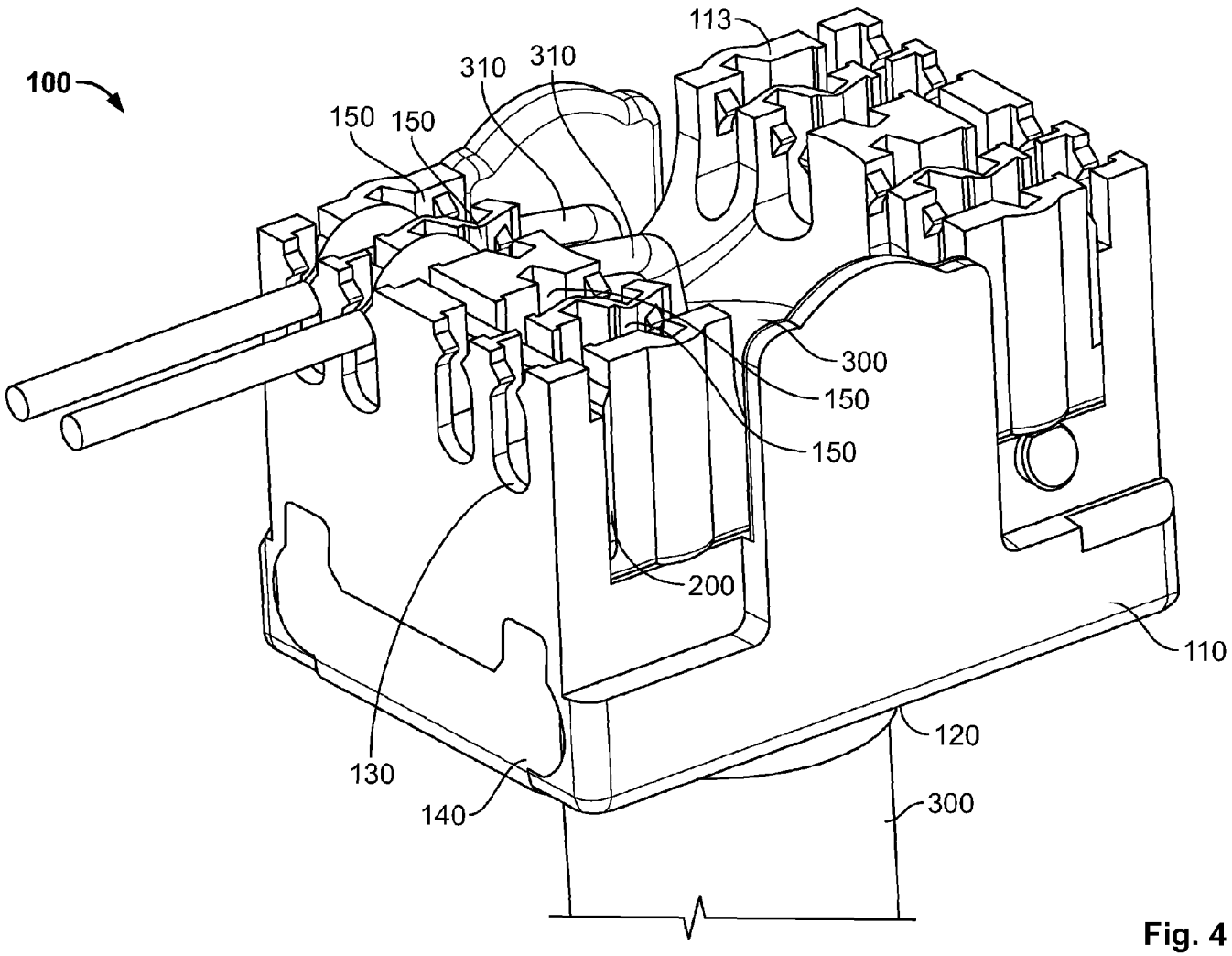
FIG. 4 shows a perspective view of the cap according to the first embodiment with a cable attached.

FIG. 4 shows a perspective view of the cap 100 with a cable 300 inserted into the aperture 200. The cable 300 is introduced into the aperture 120 from the outer side 217 of the housing 110 of the cap 100. The cable 300 is secured inside the aperture 120 by the locking member 140. The cable 300 comprises a sleeve and a plurality of wires 310. In FIG. 4 only two wires 310 are shown. The cable 300 may however comprise a larger number of wires 310. Each wire 310 may comprise an individual insulation around the respective wire 310. The cable sleeve ends at the inner side 113 of the housing 110. The two wires 310 extend further with the cable sleeve around them removed. Each wire 310 is bent by 90° and arranged in a wire guiding 150 of the cap 100. Each wire 310 runs over the cutting blade 210 of the cutting member 200 and through one respective recess 130 and ends outside the cap 100.

Figure 5:
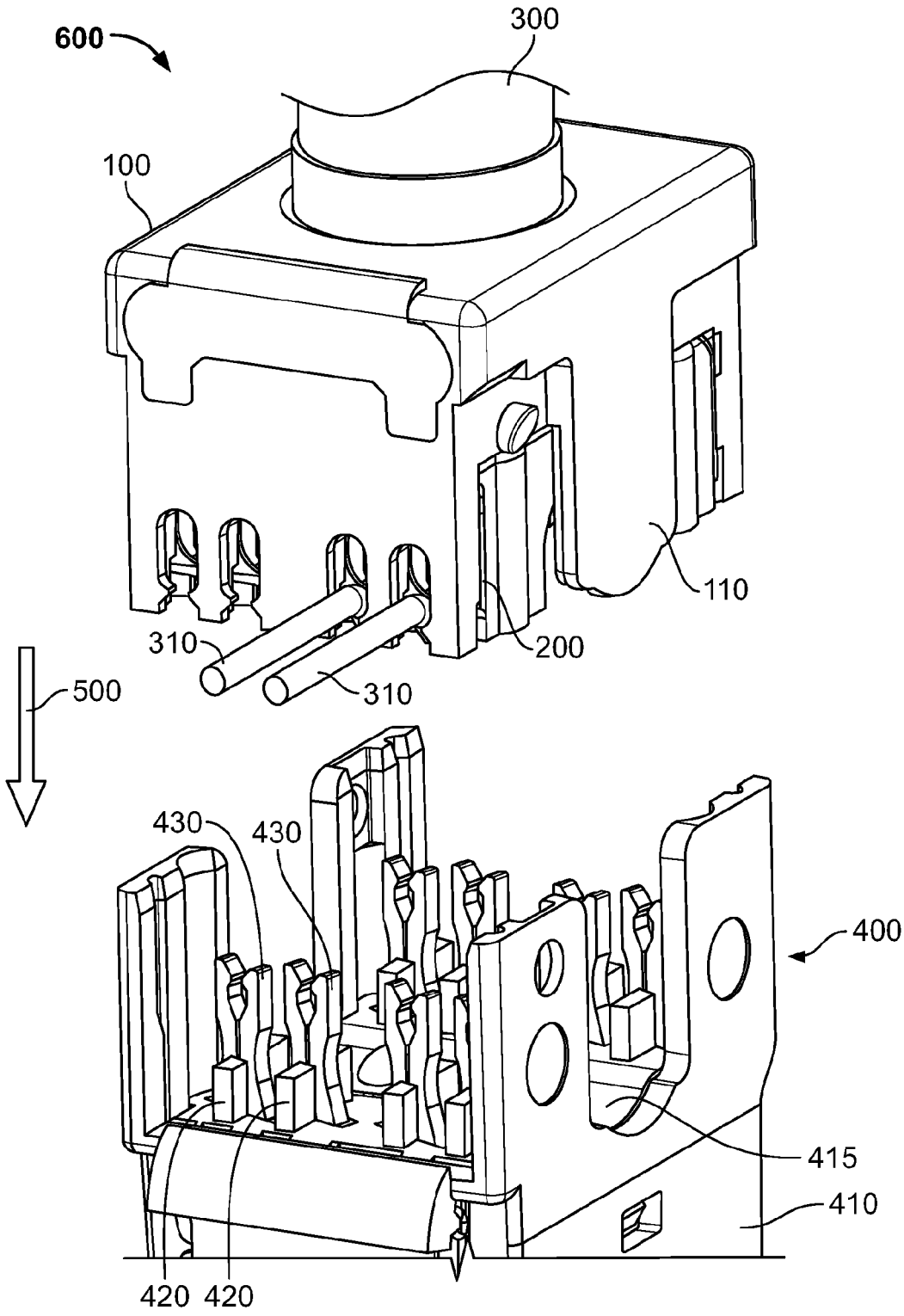
FIG. 5 shows a perspective view of an electrical connector according to the first embodiment.
Figure 6:
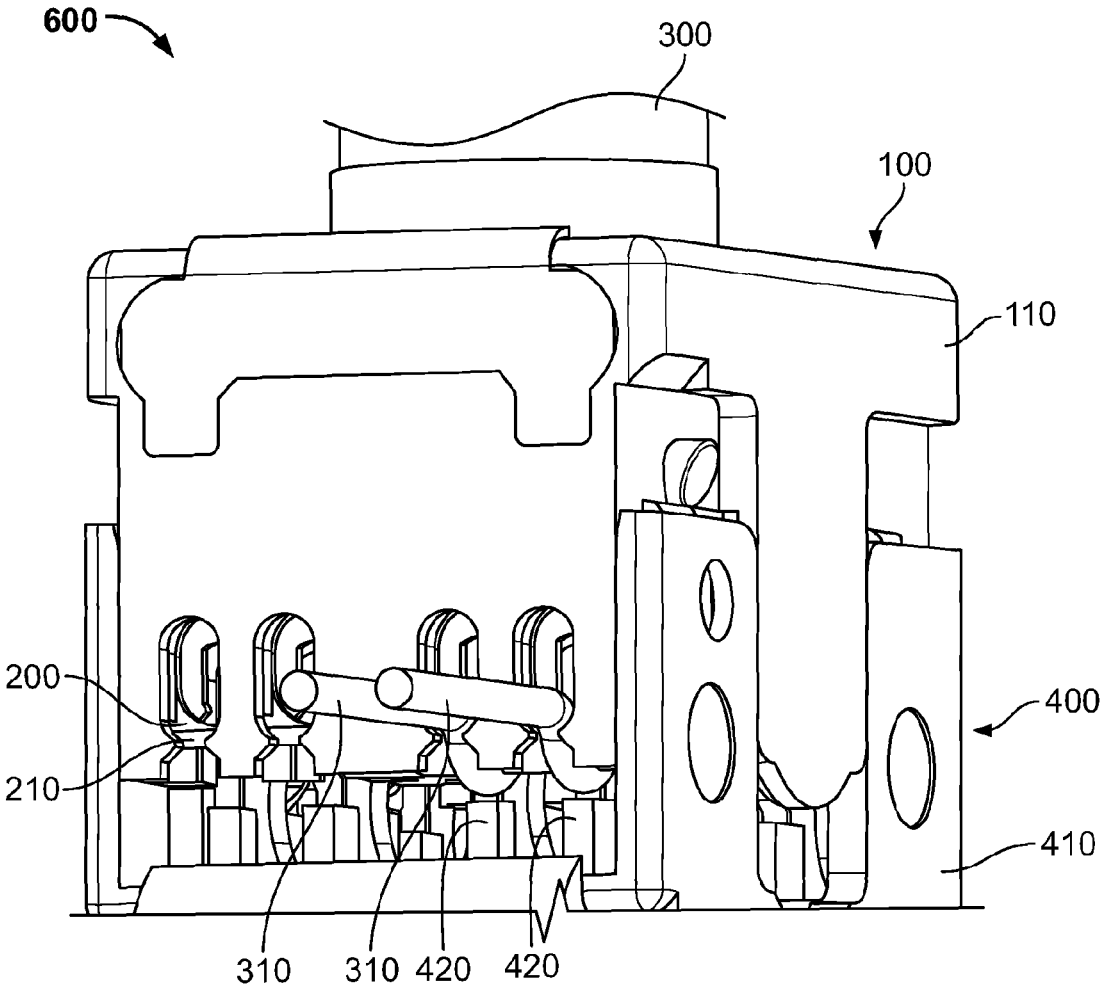
FIG. 6 shows another view of the electrical connector.
Figure 7:
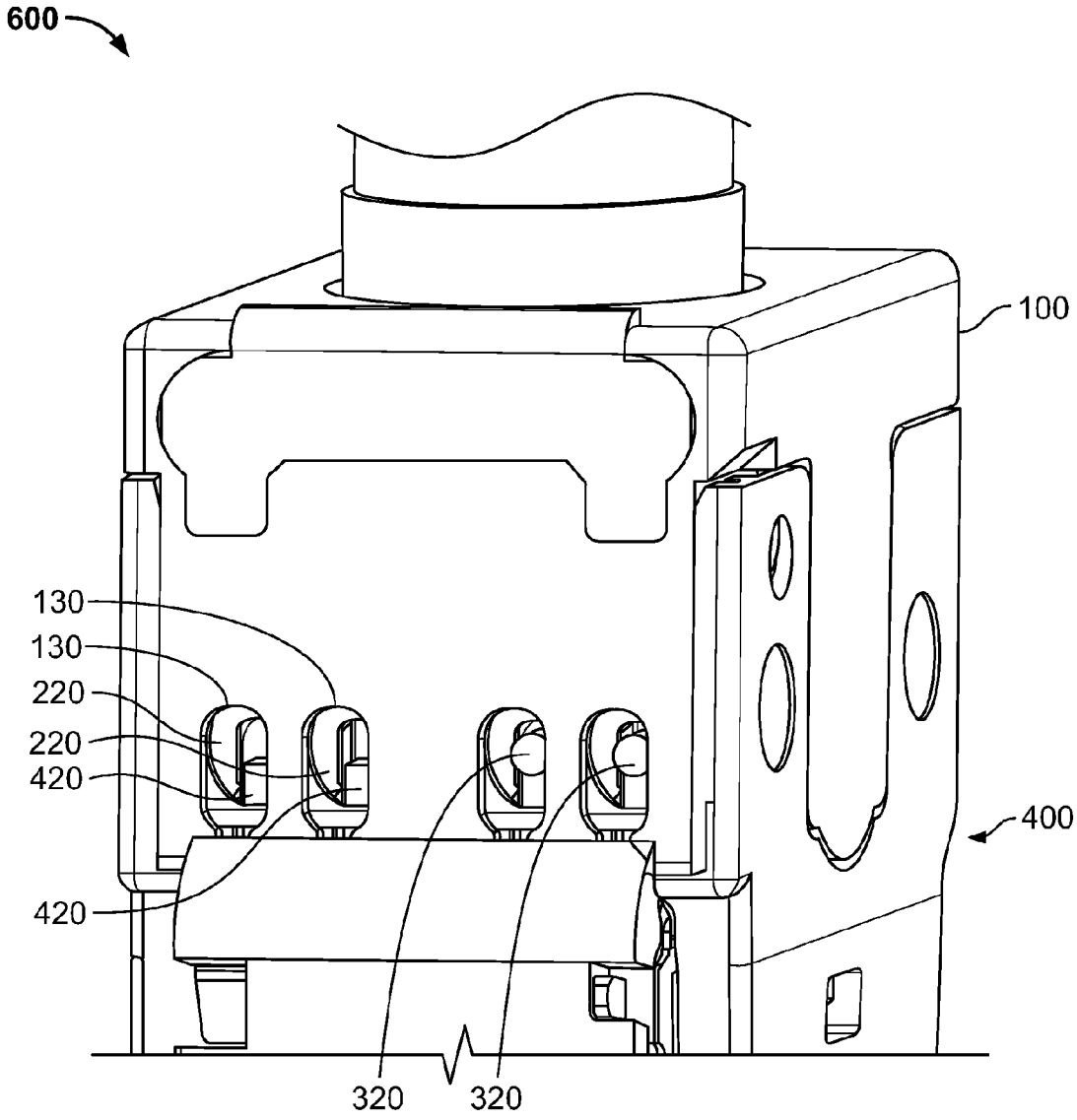
FIG. 7 shows another view of the electrical connector.

FIG. 5 shows a perspective view of an electrical connector 600 according to the first embodiment. The electrical connector 600 comprises the cap 100 described above and a termination assembly 400. The termination assembly 400 and the cap 100 may be mated with each other by pressing the cap 100 onto the termination assembly 400 in a pressing direction 500 as is shown in FIGS. 5, 6 and 7. The mating of the cap 100 and the termination assembly 400 may be performed with a gripper.

The termination assembly 400 comprises a housing 410 with a mating face 415 that will adjoin the inner side 113 of the cap 100 when the termination assembly 400 and the cap 100 are mated. The mating face 415 comprises a plurality of insulation displacement contacts 430 that extends upright from the mating face 415. Each insulation displacement contact 430 comprises two approximately parallel metallic beams that allow for receiving a wire between them. The two metallic beams of each insulation displacement contact 430 may comprise a cutting face for cutting an insulation of the wire to provide an electrical contact between the wire and the insulation displacement contact 430.

The mating face 415 of the termination assembly 400 further comprises a plurality of blocks 420. Each block 420 comprises an approximately cuboid shape. Two blocks 420 are related to each insulation displacement contact 430 respectively. One block 420 is respectively arranged on each side of each insulation displacement contact 430.

FIGS. 5, 6 and 7 show consecutive steps of pressing the cap 100 onto the termination assembly 400. While the cap 100 approaches the termination assembly 400 each wire 310 is introduced into one of the insulation displacement contacts 130 respectively. At the same time the blocks 420 press the wires 310 against the cutting blade 210 of the cutting member 200. This can be seen in FIG. 6. When the cap 100 is further pressed onto the termination assembly 400 each wire 310 is cut by the cutting blade 210 to from a cut wire 320, as is shown in FIG. 7. Each cut wire 320 is than arranged in one opening 220 of the cutting member 200. This ensures that the cut wires 320 are not short-circuited via the cutting member 200. FIG. 7 shows the electrical connector 600 in a completely assembled state.

Figure 8:
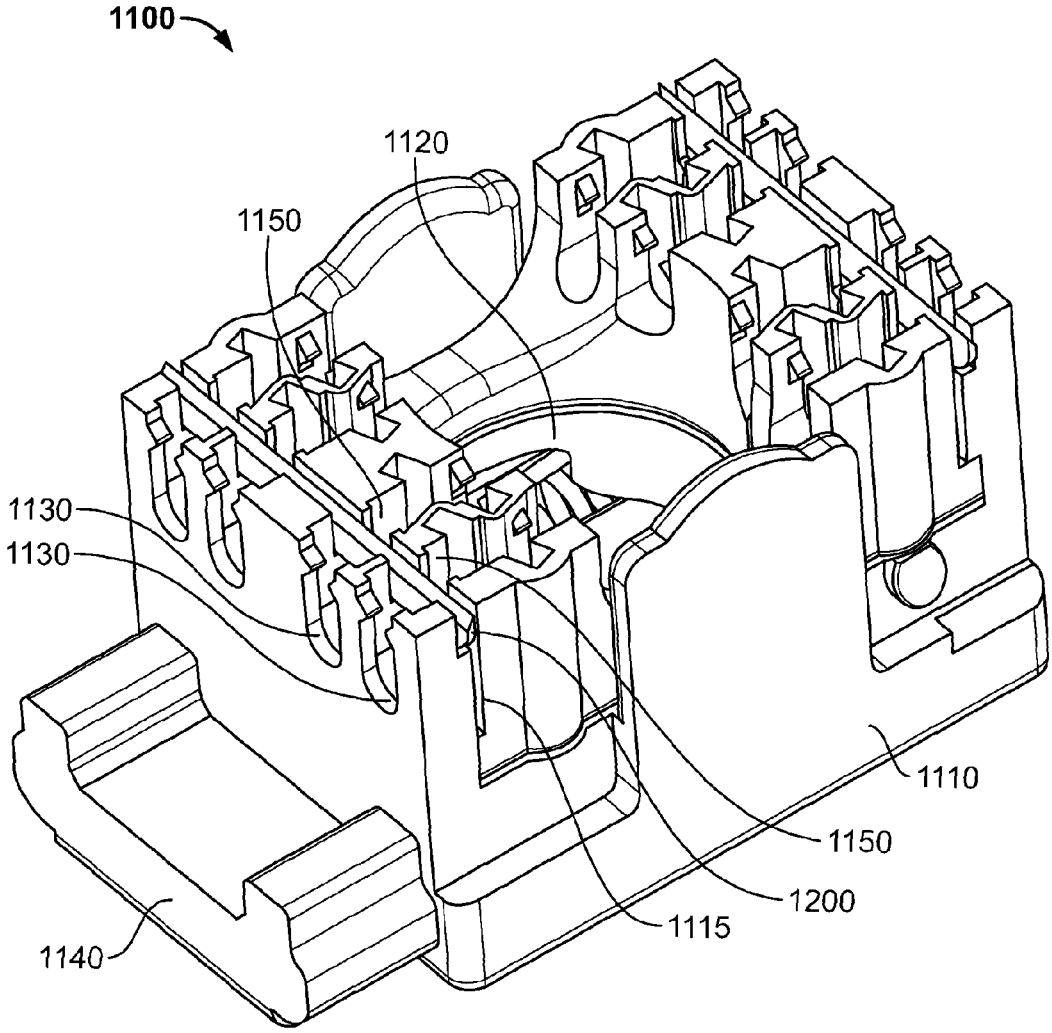
FIG. 8 shows a perspective view of a cap according to a second embodiment.
Figure 9:
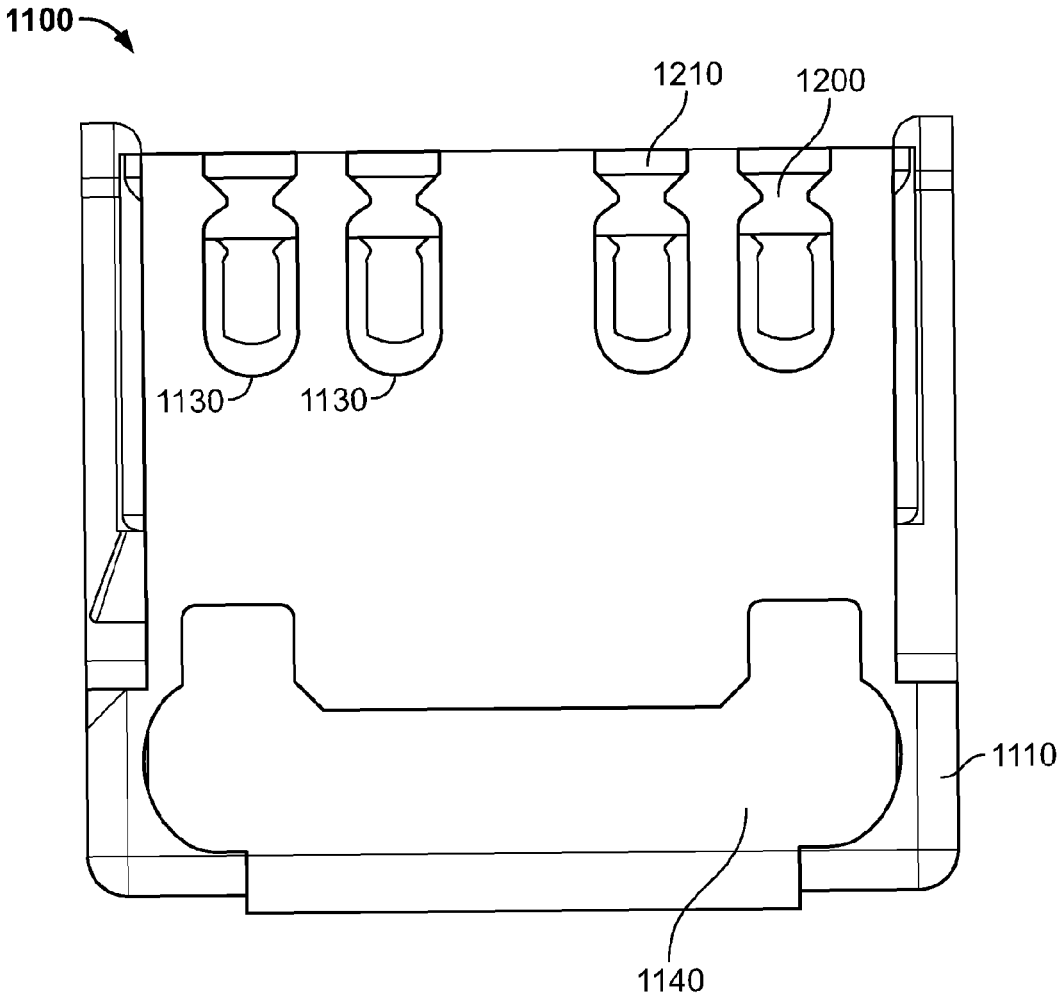
FIG. 9 shows a front view of the cap according to the second embodiment.

FIGS. 8 and 9 show a perspective view and a front view of a cap 1100 according to a second embodiment. The cap 1100 comprises a housing 1110 with an aperture 1120 for receiving a cable. A front side of the housing 1110 comprises four recesses 1130. Four wire guidings 1450 extend from the aperture 1120 in the housing 1110 to the four recesses 1130.

The front side of the housing 1110 further comprises a locking member 1140 for locking the cable inside the aperture 1120.

Figure 10:
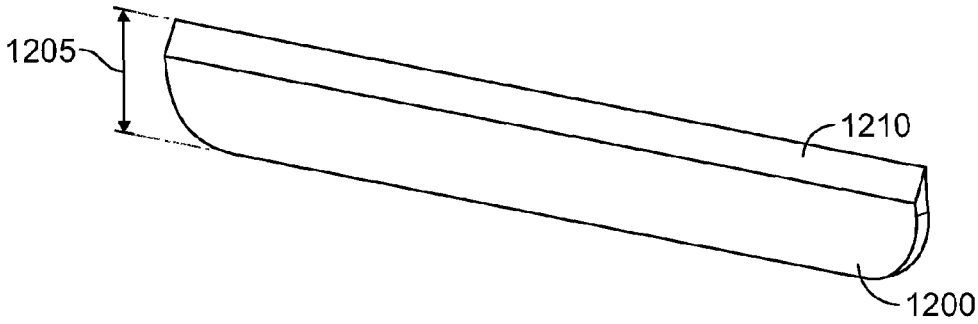
FIG. 10 shows a cutting member according to the second embodiment.

The housing 1110 comprises a slot 1115 for receiving a cutting member 1200. The cutting member 1200 is shown in FIG. 10. The cutting member 1200 comprises an approximately rectangular shape with a cutting blade 1210 arranged along one edge of the cutting member 1200. In a direction perpendicular to the cutting blade 1210 the cutting member 1200 comprises a height 1205. The height 1205 is smaller than the height 205 of the cutting member 200 shown in FIG. 3. Accordingly the slot 1115 extends less deep into the housing 1110 than the slot 115 of the cap 100 of the first embodiment described above. The cutting member 1200 does not comprise any openings. As can be seen in FIG. 9 the height 1205 of the cutting member 1200 is less than the depth of the wire guidings 1150 and the recesses 1130. Since the cutting blade 1210 is aligned with an inner side of the housing 1110, an opening between each recess 1130 and the respective wire guiding 1150 remains below the cutting member 1200.

The aperture 1120 is provided for receiving a cable 1300 with a plurality of wires 1310. Each wire 1310 is be arranged in a wire guiding 1150 and a recess 1130, running over the cutting blade 1210 of the cutting member 1200.

Figure 11:
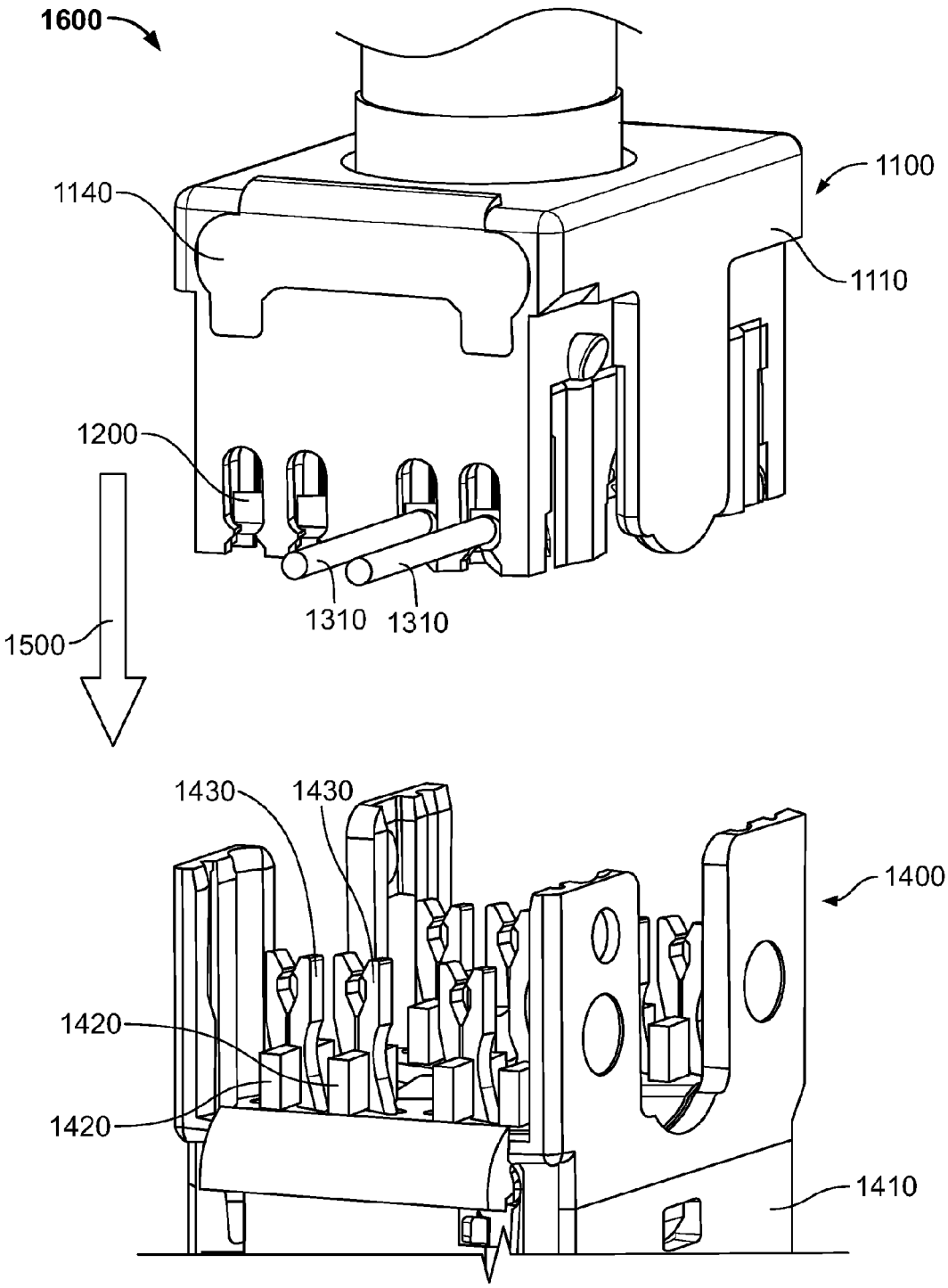
FIG. 11 shows a perspective view of an electrical connector according to the second embodiment.
Figure 12:
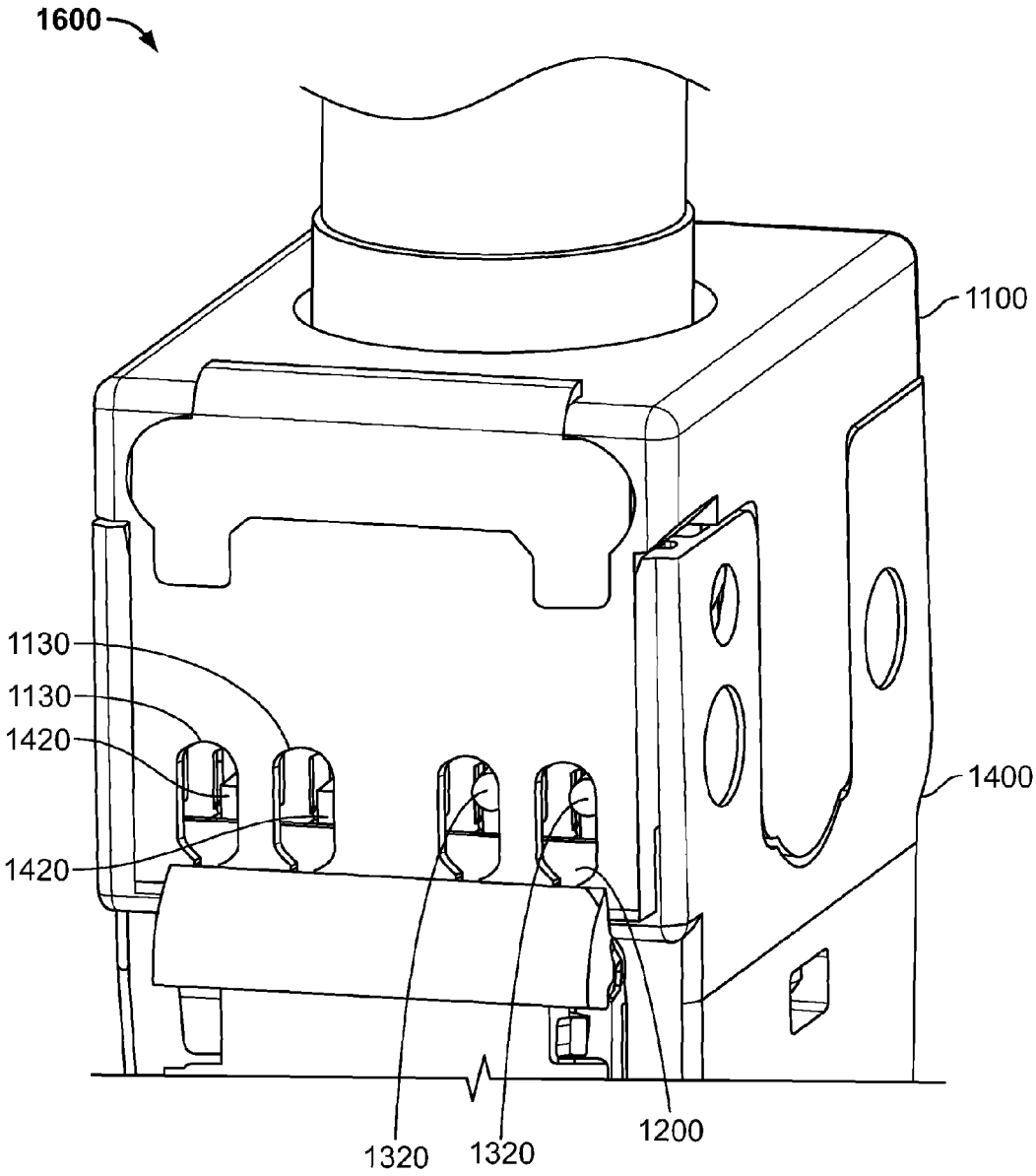
FIG. 12 shows another view of the electrical connector.

The cap 1100 may be mated with a termination assembly 1400 to form an electrical connector 1600. The termination assembly 1400 comprises a housing 1410 with a plurality of insulation displacement contacts 1430 and a plurality of blocks 1420, analogous to the termination assembly 400 described above. The cap 1100 can be pressed onto the termination assembly 1500 in a pressing direction 1500, as is shown in FIG. 11. When the cap 1100 is pressed onto the termination assembly 1400, each wire 1310 is pressed into one of the insulation displacement contacts 1430. At the same time the blocks 1420 press the wires 1310 against the cutting blade 1210 to cut the wires 1310. When the electrical connector 1600 is completely assembled each cut wire 1320 is arranged in the open space between the cutting member 1200 and the floor of the wire guidings 1150 and the recesses 1130, preventing a short-circuit between individual cut wires 1320 via the cutting member 1200. This is shown in FIG. 12.

Figure 13:
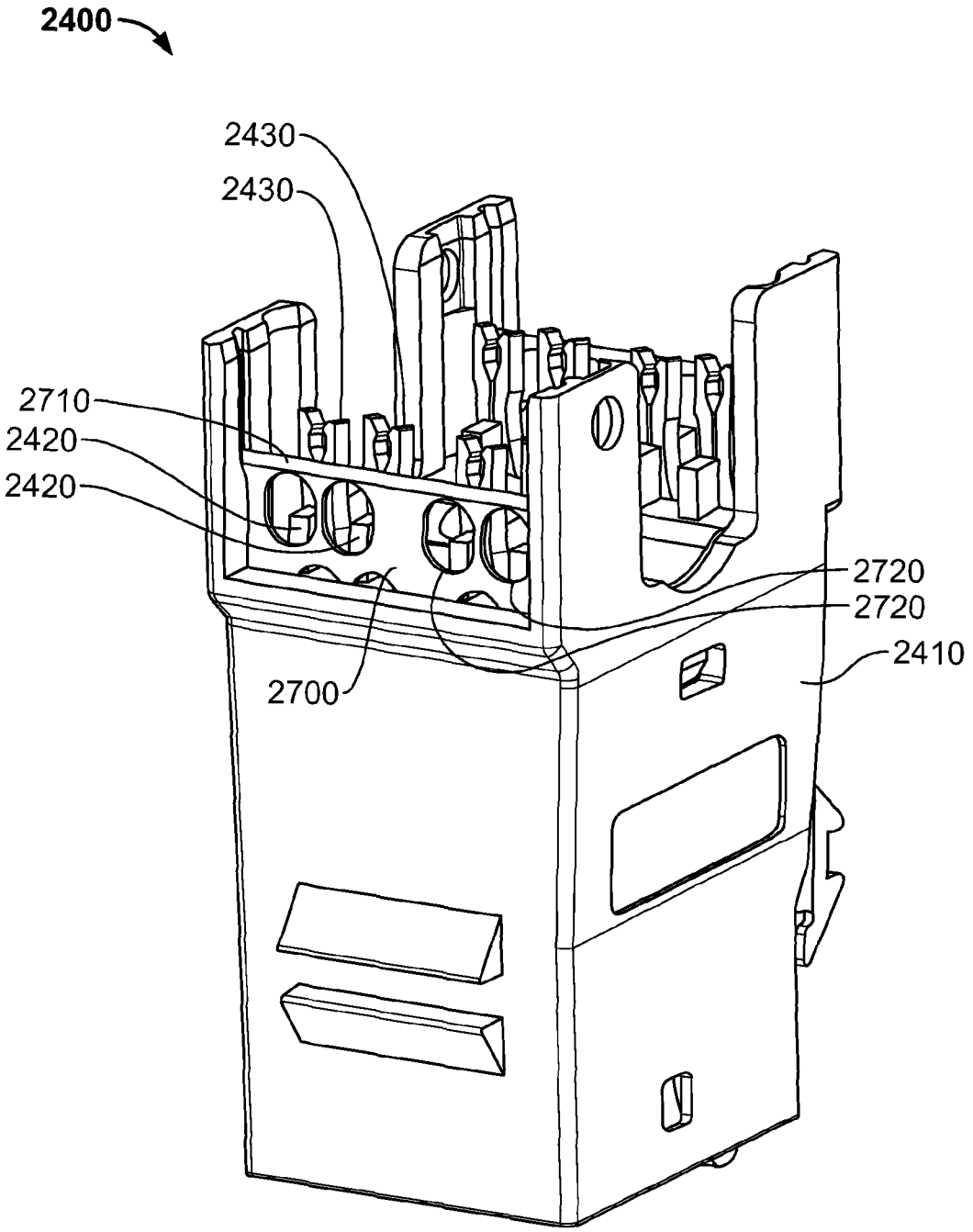
FIG. 13 shows a perspective view of a termination assembly according to a third embodiment.

FIG. 13 shows a perspective view of a termination assembly 2400 according to a third embodiment. Like the termination assemblies 400 and 1400 described above the termination assembly 2400 comprises a housing 2410 with a plurality of insulation displacement contacts 2430 and blocks 2420. Unlike the termination assemblies 400, 1400 described previously, the termination assembly 2400 of FIG. 13 comprises a cutting member 2700 with a cutting blade 2710 and four openings 2720. The cutting member 2700 comprises an approximately rectangular shape. The cutting blade 2710 is arranged along one edge of the cutting member 2700. The four openings 2720 are arranged along the cutting blade 2710. The cutting member 2700 is similar or identical to the cutting member 200 shown in FIG. 3.

Figure 14:
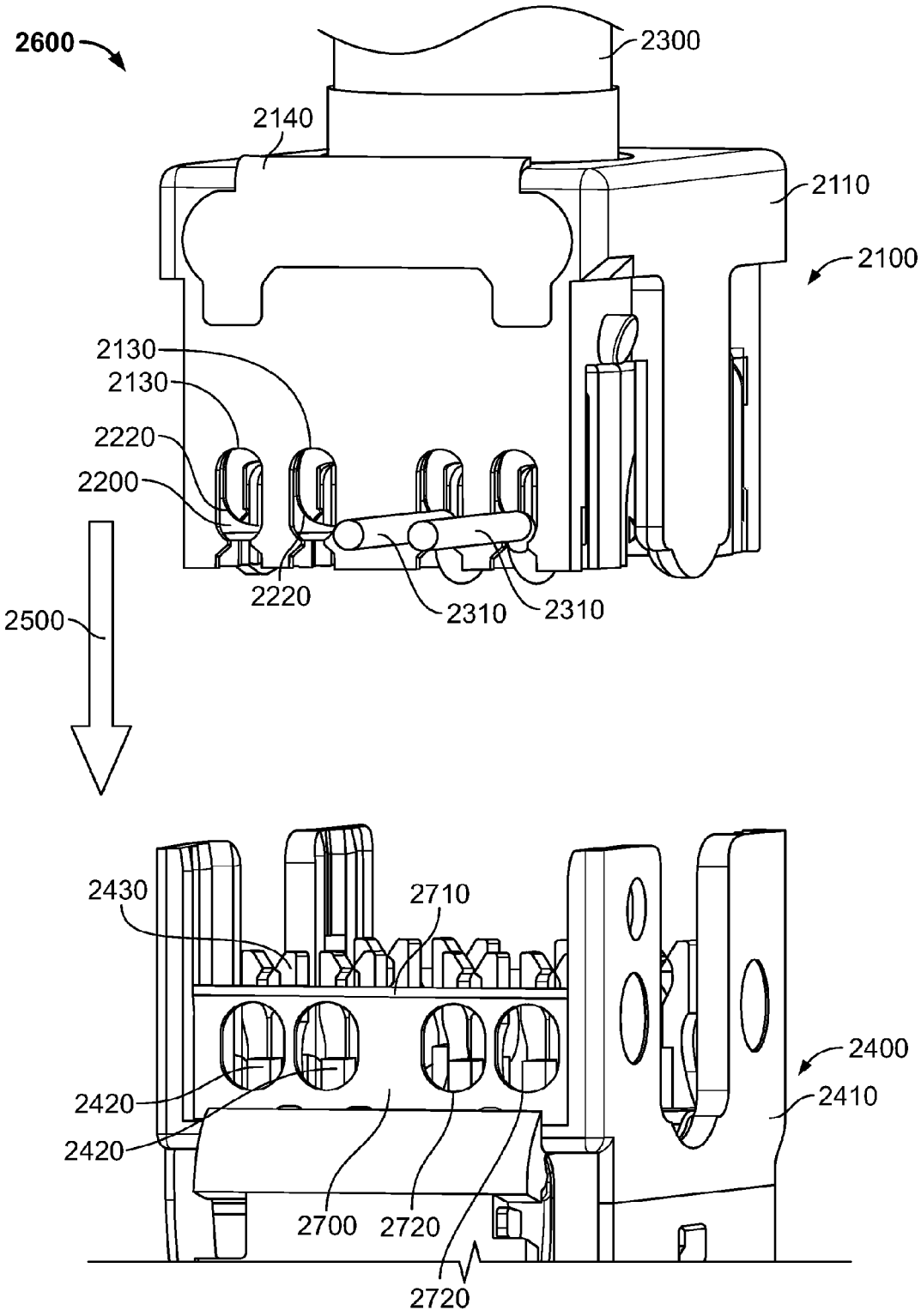
FIG. 14 shows a perspective view of an electrical connector according to the third embodiment.
Figure 15:
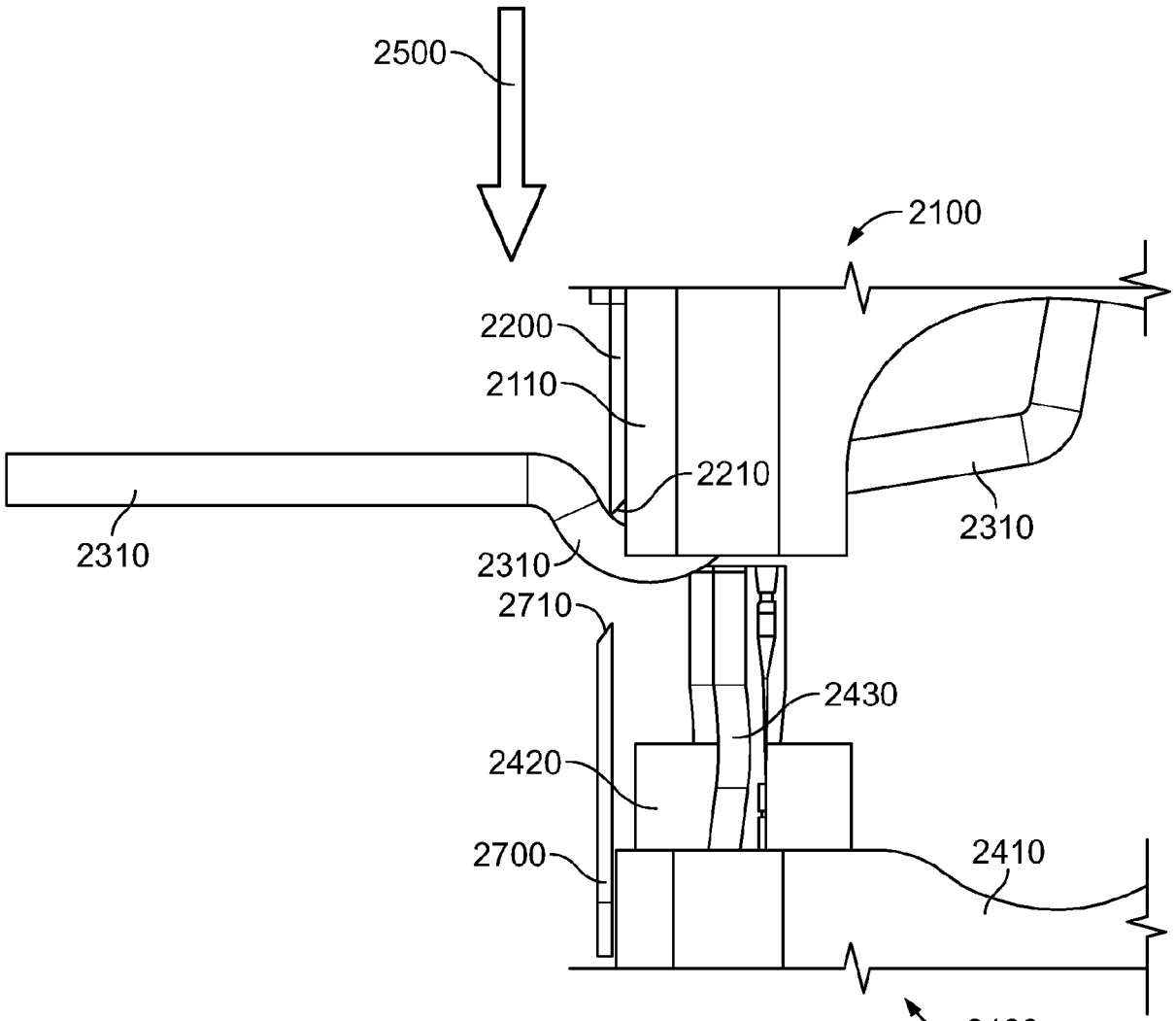
FIG. 15 shows a magnified side view of the electrical connector according to the third embodiment.
Figure 16:
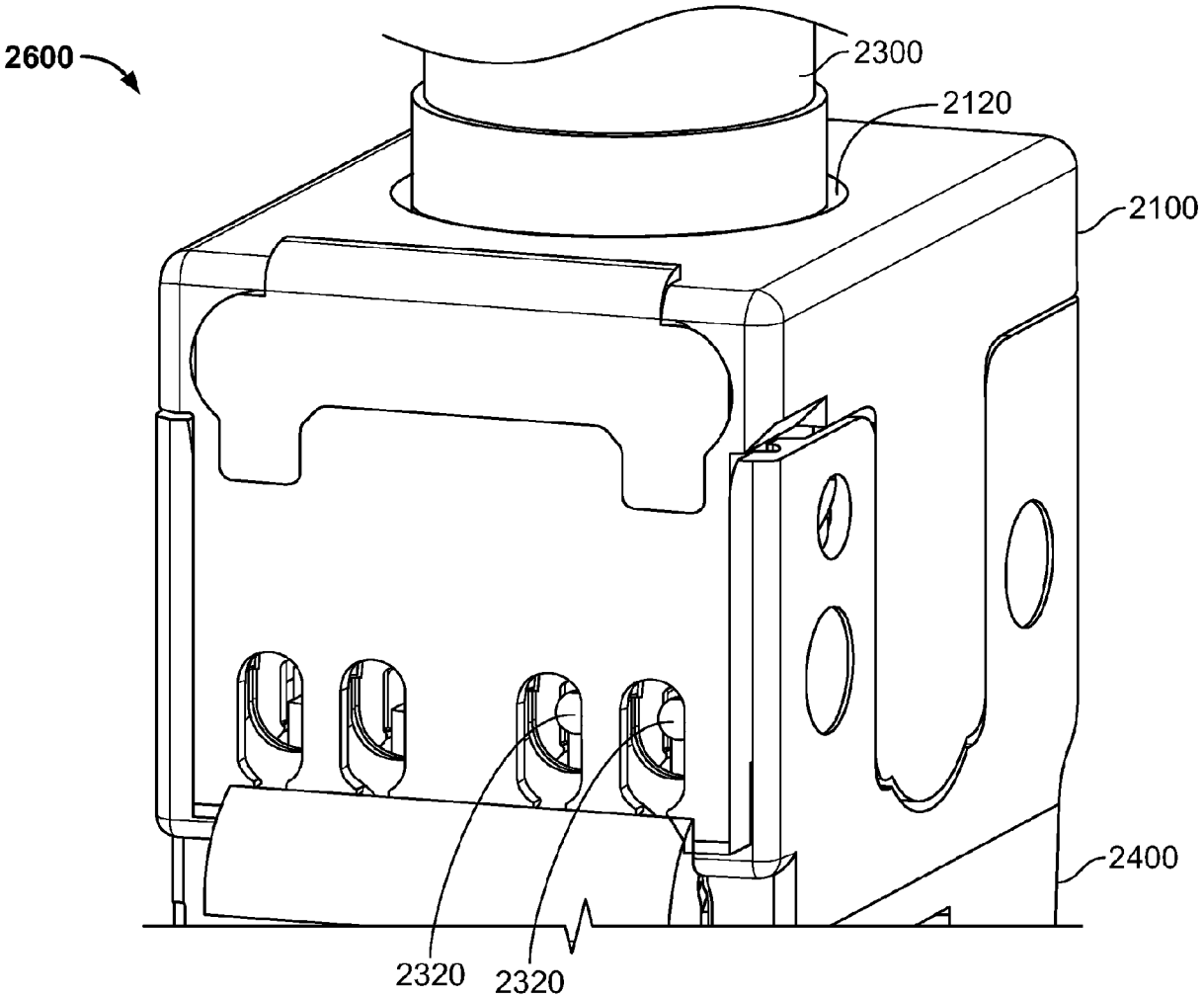
FIG. 16 shows another view of the electrical connector according to the third embodiment.

The termination assembly 2400 may be combined with a cap 2100 to form an electrical connector 2600. This is shown in FIGS. 14, 15 and 16. The cap 2100 is identical or similar to the cap 100 described with reference to FIG. 1 above. The cap 2100 comprises a housing 2110 with an aperture 2120 for receiving a cable 2300 with a plurality of wires 2310. The cap 2100 furthermore comprises a locking member 2140 for locking the cable 2300 inside the aperture 2120. The cap 2100 furthermore comprises four recesses 2130. The cap 2100 furthermore comprises a cutting member 2200 with four openings 2220 arranged in parallel to a cutting blade 2210 of the cutting member 2200. The cutting member 2200 is similar or identical to the cutting member 200 shown in FIG. 3.

FIG. 15 shows a side view of a detail of the electrical connector 2600 while the cap 2100 is pressed onto the termination assembly 2400 in a pressing direction 2500. One of the wires 2310 is shown between the cutting blade 2210 of the cutting member 2200 of the cap 2100 and the cutting blade 2710 of the cutting member 2700 of the termination assembly 2400. If the cap 2100 is further pressed onto the termination assembly 2400 in the pressing direction 2500 the cutting member 2200 and the cutting member 2700 slide alongside each other, cutting the wire 2310 like a pair of scissors. At the same time the wire 2310 is pressed into one of the insulation displacement contacts 2430 to create an electrical contact between the insulation displacement contact 2430 and the wire 2310. In the final arrangement of the electrical connector 2600 the cutting member 2200 of the cap 2100 is arranged between the cutting member 2700 of the termination assembly 2400 and the insulation displacement contact 2430. The openings 2220 of the cutting member 2200 of the cap 2100 and the openings 2720 of the cutting member 2700 of the termination assembly 2400 are aligned with each other. The wire 2310 is cut to form a cut wire 2320 that rests in the openings 2220 and 2720 of the cutting members 2200 and 2700, preventing an electrical short-circuit between individual cut wires 2320 via the cutting members 2200 and 2700. The final arrangement of the electrical connector 2600 is shown in FIG. 16.

In a further embodiment of the invention, not depicted in the figures, an electrical connector is comprised of the cap 1100 shown in FIG. 8, comprising a cutting member 1200 with no openings, and of a termination assembly with a cutting member with no openings, like the cutting member 1200 shown in FIG. 10.

Figure 17:
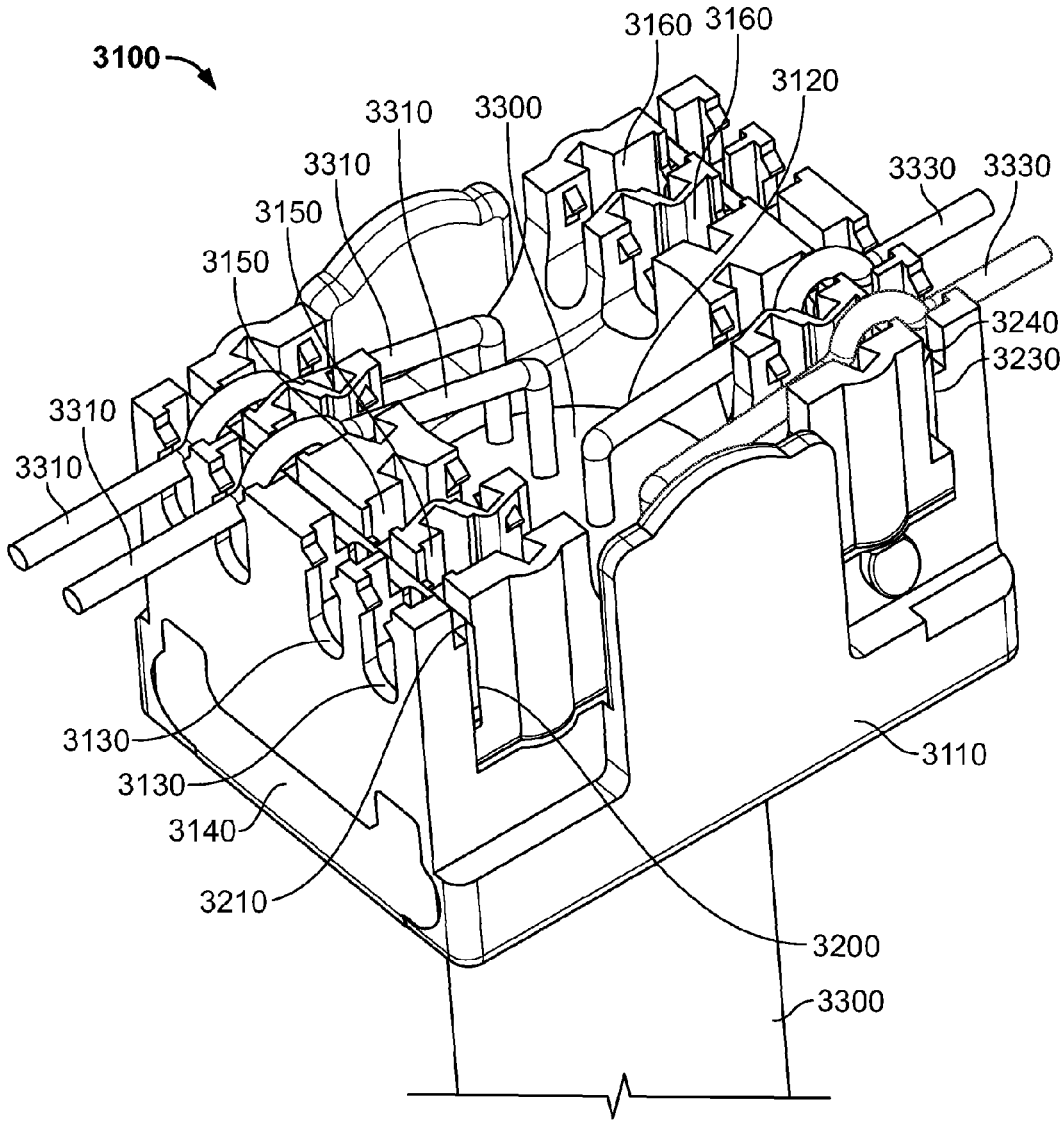
FIG. 17 shows a cap according to a fourth embodiment.

FIG. 17 shows a cap 3100 according to a fourth embodiment. The cap 3100 comprises a housing 3110 with an aperture 3120 for receiving a cable 3300. In the embodiment of FIG. 17 the cable 3300 comprises two first wires 3310 and two second wires 3330.

Like in the previous embodiments a front side of the cap 3100 comprises a locking member 3140 for locking the cable 3300 inside the aperture 3120. The front side furthermore comprises four recesses 3130. Four first wire guidings 3150 run from one respective recess 3130 towards a central area of the housing 3110 near the aperture 3120. The cap 3100 furthermore comprises a first cutting member 3200 with a first cutting blade 3210. The first cutting member crosses the first wire guidings 3150 as described above. The first cutting member 3200 may be a cutting member comprising openings like the cutting member 200 of FIG. 3 or a cutting member without openings like the cutting member 1200 of FIG. 10. The two first wires 3310 are arranged in two first wire guidings 3150, running over the first cutting member 3200 and through one recess 3130 each.

The cap 3100 furthermore comprises four second wire guidings 3160 that run from the aperture 3120 towards a backside of the cap 3100 on the opposite side of the front side of the cap 3100. The backside of the cap 3100 comprises four recesses that are analogous to the recesses 3130 in the front side of the cap 3100 and are not visible in FIG. 17. A second cutting member 3230 approximately perpendicularly crosses the four second wire guidings 3160. The second cutting member 3230 comprises a second cutting blade 3240. The second cutting member 3230 may be a cutting member comprising openings like the cutting member 200 shown in FIG. 3 or a cutting member without openings like the cutting member 1200 shown in FIG. 10. Preferentially the cutting member 3230 is the same kind of cutting member as the cutting member 3200. The two second wires 3330 are arranged in one second wire guiding 3160 each and run over the second cutting blade 3240 of the second cutting member 3230.

In an alternative embodiment the cable 3300 may comprise up to eight wires. In this embodiment four first wires 3310 of the cable 3300 are arranged in the four first wire guidings 3150 and four second wires 3330 of the cable 3300 are arranged in the four second wire guidings 3160.

Figure 18:
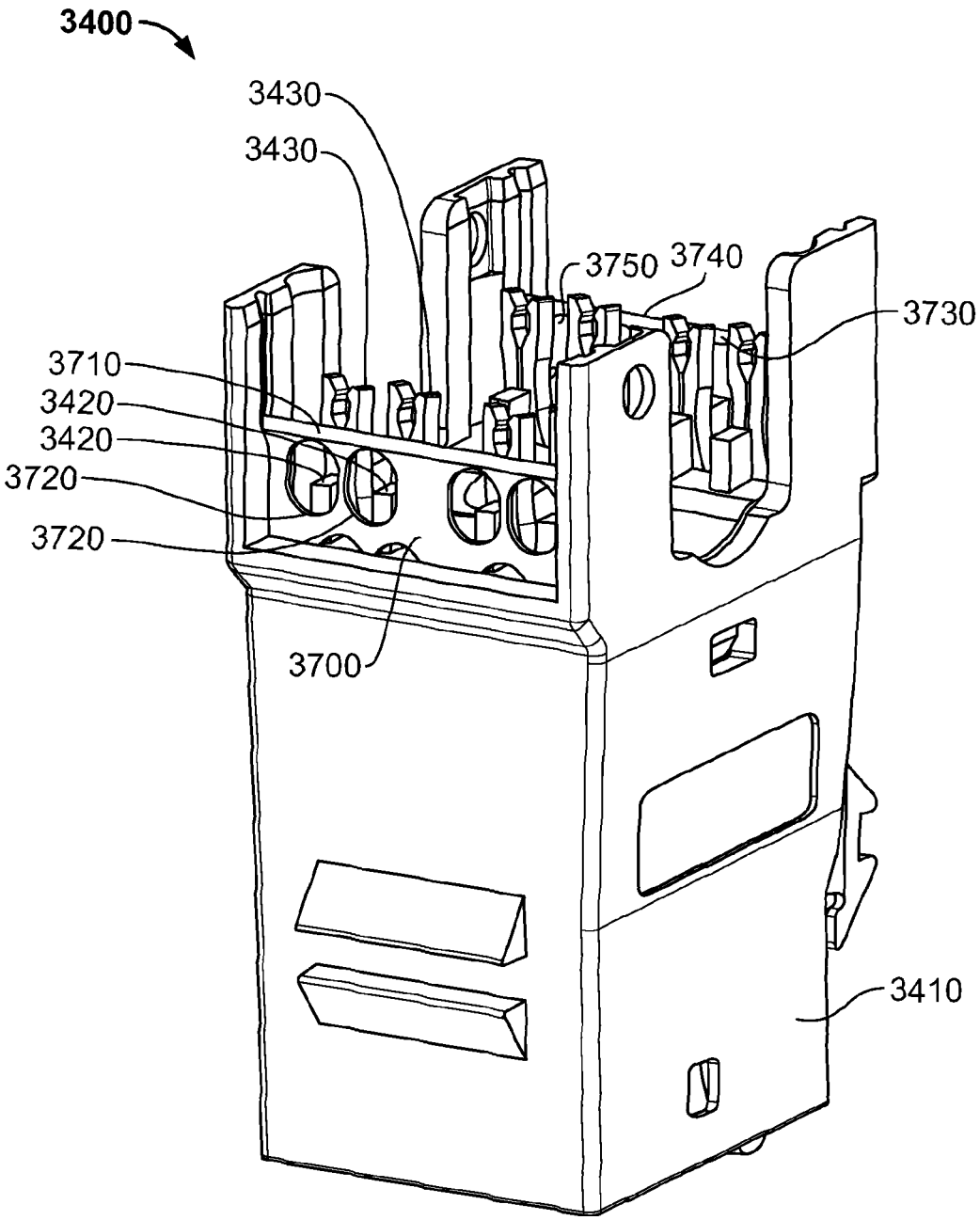
FIG. 18 shows a perspective view of a termination assembly according to the fourth embodiment.

The cap 3100 may be combined with a termination assembly 3400 shown in FIG. 18 to form an electrical connector. The termination assembly 3400 comprises a housing 3410. An upper mating face of the housing 3410 comprises eight insulation displacement contacts 3430 extending upright from the mating face. The mating face of the housing 3410 furthermore comprises 16 blocks 3420. Each insulation displacement contact 3430 is arranged between two blocks 3420. The termination assembly 3400 furthermore comprises a first cutting member 3700 and a second cutting member 3730 arranged on two opposite edges of the mating face of the termination assembly 3400. The first cutting member 3700 comprises a first cutting blade 3710 and four first openings 3720 arranged in parallel to the first cutting blade 3710. The second cutting member 3730 comprises a second cutting blade 3740 and four second openings 3750 arranged in parallel to the second cutting blades 3740. The cutting members 3700, 3730 are similar or identical to the cutting member 200 describes above with reference to FIG. 3. In an alternative embodiment the first cutting member 3700 and the second cutting member 3730 may be cutting members without openings like the cutting member 1200 shown in FIG. 10.

If the cap 3100 of the FIG. 17 is pressed onto the termination assembly 3400 of FIG. 18 the first cutting member 3200 of the cap 3100 and the first cutting member 3700 of the termination assembly 3400 together cut the first wires 3310 of the cable 3300 as shown in FIG. 15 above. The second cutting member 3230 of the cap 3100 and the second cutting member 3730 of the termination assembly 3400 cut the second wires 3330 of the cable 3300 as shown in FIG. 15 above. At the same time the first wires 3310 and the second wires 3330 are each pressed into of the insulation displacement contacts 3430 of the termination assembly 3400 respectively to electrically contact the first wires 3310 and the second wires 3330.

In yet another embodiment the cap 3100 of FIG. 17 may be combined with a termination assembly without cutting members.

Figure 19:
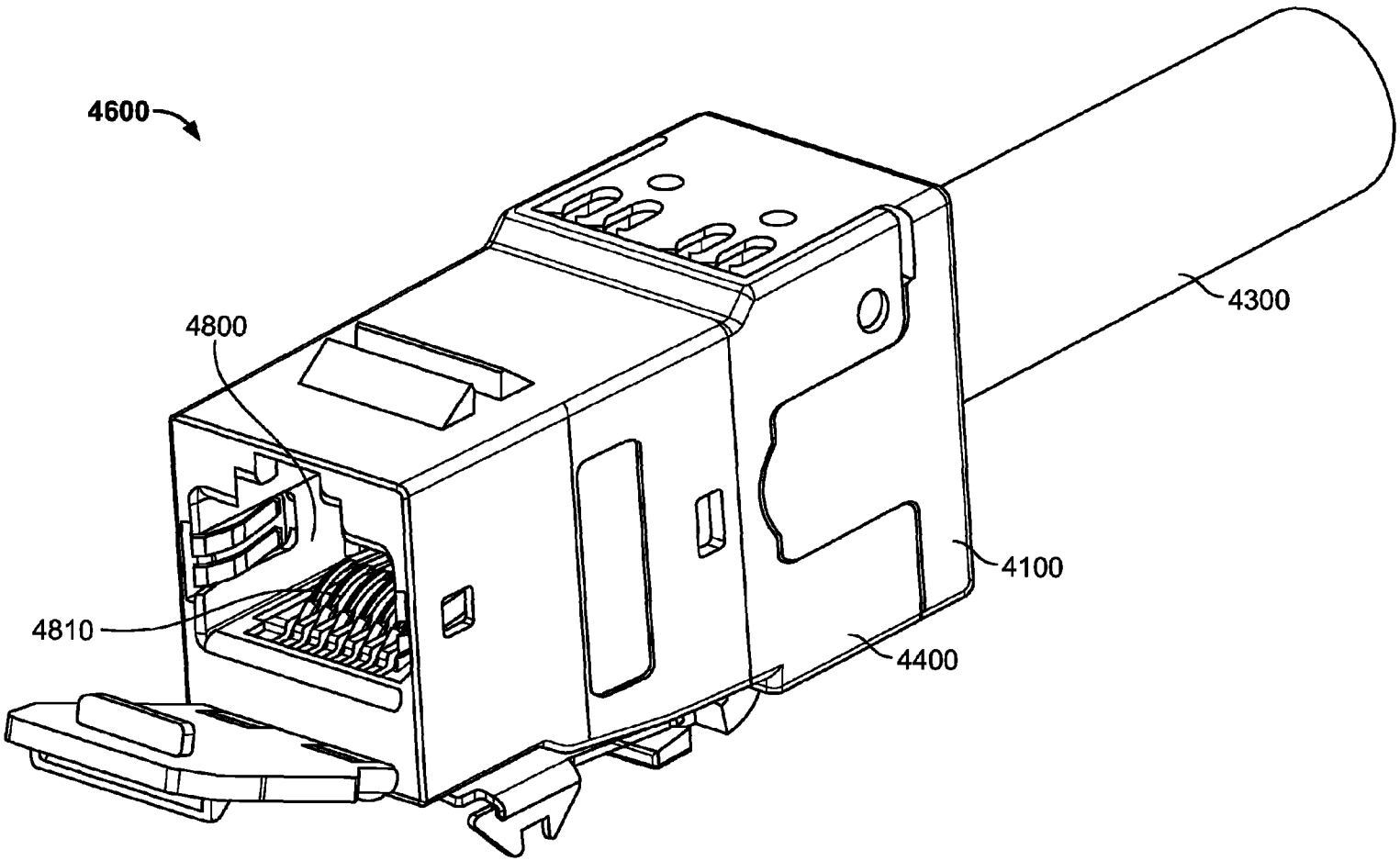
FIG. 19 shows a perspective view of an electrical connector.

FIG. 19 shows a perspective view of an electrical connector 4600 comprising a cap 4100 and a termination assembly 4400. A cable 4300 is arranged in an aperture of the cap 4100. Individual wires of the cable 4300 are electrically connected to insulation displacement contacts inside the termination assembly 4400, as was described above.

A surface of the termination assembly 4400 that is arranged on the opposite side of the cap 4100 comprises a socket 4800 with a plurality of electrically conductive pins 4810. In the example shown in FIG. 19 the socket 4800 is a registered jack for telecommunication applications. The socket 4800 may however be any kind of socket suitable for the desired application of the electrical connector 4600. Each of the conductive pins 4810 is electrically connected to one insulation displacement contact of the termination assembly 4400. Since each insulation displacement contact is electrically connected to one wire of the cable 4300, each pin 4810 is thus electrically connected to one wire of the cable 4300 respectively.

In summary, an electrical connector according to the invention comprises a cap and a termination assembly. The cap may comprise one or more cutting members. The termination assembly may comprise zero or more cutting members. The cutting members may comprise openings for receiving cut wire ends for preventing an electrical short-circuit of individual cut wires. Alternatively, the cutting members may comprise a reduced height that leaves an opening between the cutting members and a cap body. Cut wires then rest in this opening for preventing an electrical short-circuit of individual cut wires.

In a preferred embodiment the caps 100, 1100, 2100, 3100, 4100 may comprise a shielding component that is electrically connected to a shielding of the cables 300, 1300, 2300, 3300, 4300. The shielding component may be an electrically conductive shielding that surrounds the wire guidings 150, 3150, 3160. The shielding is provided for reducing an electromagnetic emission and immission. In a preferred embodiment the shielding component is provided by the housing 110, 1110, 2110, 3110 of the caps 100, 1100, 2100, 3100, 4100. In this embodiments the housing of the cap is electrically conductive, for example formed of a metal.

In a further preferred embodiment also the termination assemblies 400, 1400, 2400, 3400, 4400 comprise a electrically conductive shielding component. This shielding component may be electrically connected to a shielding component of a mating cap. The shielding components of the termination assemblies 400, 1400, 2400, 3400, 4400 surround the insulation displacement contacts 430, 1430, 2430, 3430 of the termination assemblies 400, 1400, 2400, 3400, 4400 to reduce an emission and immission of electromagnetic radiation. In a further preferred embodiment the housings 410, 1410, 2410, 3410 are electrically conductive, for example formed of a metal, and constitute the shielding component. In this embodiment the insulation displacement contacts 430, 1430, 2430, 3430 are electrically isolated from the housings 410, 1410, 2410, 3410.

FIG. 1 shows that the inner side 113 of the cap 100 comprises eight IDC recesses 114. Each IDC recess 114 extends from the surface of the inner side 113 into the cap 100 in parallel to the aperture 120. Each IDC recess 114 is associated with one wire guiding 150 and is provided for receiving an insulation displacement contact of a mating termination assembly. Each IDC recess 114 comprises a rectangular opening with a clear area that is large enough for receiving the insulation displacement contact. Each IDC recess 114 crosses one wire guiding 150. Each IDC recess 114 is tilted around an axis parallel to the aperture 120 with respect to the associated wire guiding 150. Consequently, the rectangular opening of each IDC recess 114 includes an angle with the associated wire guiding 150 that is not equal to a multiple of 90 degrees.

FIG. 5 shows that the insulation displacement contacts 430 arranged on the mating face of the termination assembly 400 are likewise tilted around an upward axis by the same angle as the angle that the IDC recesses 114 are tilted with respect to the wire guidings 150. Consequently, the insulation displacement contacts 430 may be received in the IDC recesses 114 of the cap 100. An advantage of the tilted arrangement of the insulation displacement contacts 430 of the termination assembly 400 and the tilted arrangement of the IDC recesses 114 of the cap 100 is that it allows for a space-saving arrangement of the insulation displacement contacts 430 on the termination assembly 400.

The invention claimed is:

1. A cap for an electrical connector, the cap comprising a housing and a first cutting member with a first cutting blade, the housing including an aperture for receiving a cable therethrough, the housing comprising at least a first wire guiding for guiding a first wire of the cable between the aperture and a first recess in a first outside wall of the housing, the first cutting member being arranged in a first slot of the housing and crossing the first wire guiding between the aperture and the first recess, wherein the first cutting member is provided for cutting the first wire.

2. The cap according to claim 1, wherein the first cutting member comprises at least one opening, wherein the opening is arranged between the first recess in the housing and the first wire guiding, wherein an end of the first wire is arranged in the opening after the first wire has been cut by the first cutting member.

3. The cap according to claim 1, wherein the first cutting member comprises a height that is lower than the depth of the first wire guiding, wherein the first cutting member is arranged in the first slot such that there is a clearance between the first cutting member and a floor of the first wire guiding.

4. The cap according to claim 1, wherein the housing includes an electromagnetic shielding component for electrically contacting a shield of the cable.

5. The cap according to claim 4, wherein the housing is formed of a conductive material, wherein the shielding component is constituted by the housing.

6. The cap according to claim 1, wherein the cap comprises a second wire guiding for guiding a second wire of the cable between the aperture and a second recess in a second outside wall of the housing and a second cutting member including a second cutting blade, the second cutting member being arranged in a second slot of the housing and crossing the second wire guiding between the aperture and the second recess.

7. The cap according to claim 1, wherein the cap comprises a locking member for locking the cable in the aperture.

8. A termination assembly for an electrical connector, the termination assembly comprising a housing and an insulation displacement contact for contacting a wire, wherein the insulation displacement contact extends upright from an outer surface of the housing, wherein the termination assembly is designed for being mated with a cap according to any of the previous claims.

9. The termination assembly according to claim 8, wherein the termination assembly comprises at least a first block, wherein the first block is arranged next to the insulation displacement contact on the outer surface of the housing, wherein the first block is provided for pressing a wire against a cutting blade of the cap when the termination assembly is mated with the cap.

10. The termination assembly according to claim 9, wherein the termination assembly comprises a second block, wherein the second block is arranged next to the insulation displacement contact on the outer surface of the housing such that the insulation displacement contact is arranged between the first block and the second block.

11. The termination assembly according to claim 8, wherein the termination assembly comprises a cutting member with a cutting blade, wherein the cutting member is arranged upright on the outer surface of the housing.

12. The termination assembly according to claim 8, wherein the termination assembly comprises a socket with a conductive pin, wherein the pin is electrically connected to the insulation displacement contact.

13. The termination assembly according to claim 12, wherein the socket is of the registered jack type.

14. An electrical connector comprising a cap according to claim 1 and a termination assembly according to claim 7.

15. The electrical connector according to claim 14, wherein the first wire guiding of the cap comprises a third recess for receiving the insulation displacement contact of the termination assembly, wherein the third recess comprises a rectangular opening, wherein no border of the rectangular opening is parallel to the first cutting member.

* * * * *